US009109342B1

(12) United States Patent
Srackangast

(10) Patent No.: US 9,109,342 B1
(45) Date of Patent: Aug. 18, 2015

(54) MANHOLE

(75) Inventor: James V. Srackangast, Concord, NC (US)

(73) Assignee: Monobend Technologies LLC, Harrisburg, NC (US)

( * ) Notice: Subject to any disclaimer, the term of this patent is extended or adjusted under 35 U.S.C. 154(b) by 743 days.

(21) Appl. No.: 12/970,502

(22) Filed: Dec. 16, 2010

Related U.S. Application Data

(60) Provisional application No. 61/284,717, filed on Dec. 23, 2009.

(51) Int. Cl.
*E02D 29/12* (2006.01)
*E03F 5/02* (2006.01)

(52) U.S. Cl.
CPC .. *E02D 29/12* (2013.01); *E03F 5/02* (2013.01)

(58) Field of Classification Search
CPC ..... E02D 29/12; E02D 29/1454; E03F 5/02; Y10T 137/6991; Y10T 137/7025
USPC ..... 137/236.1, 363, 372; 52/20, 21; 220/484
See application file for complete search history.

(56) References Cited

U.S. PATENT DOCUMENTS

| | | | | |
|---|---|---|---|---|
| 631,867 | A | 8/1899 | Beaver | |
| 1,582,191 | A | 4/1926 | Snooke | |
| 2,068,648 | A | 1/1937 | Kaplan | |
| 2,775,469 | A | 12/1956 | Brown et al. | |
| 2,973,977 | A | 3/1961 | Stovall | |
| 3,562,969 | A | 2/1971 | Little, Jr. | |
| 3,654,952 | A | 4/1972 | Howe et al. | |
| 3,714,961 | A * | 2/1973 | Davidson et al. | 137/363 |
| 3,715,958 | A * | 2/1973 | Crawford et al. | 52/21 |
| 3,759,285 | A * | 9/1973 | Yoakum | 137/363 |
| 3,787,078 | A | 1/1974 | Williams | |
| 4,253,282 | A | 3/1981 | Swartz | |
| 4,346,921 | A | 8/1982 | Gill et al. | |

(Continued)

FOREIGN PATENT DOCUMENTS

| | | |
|---|---|---|
| DE | 2723579 A1 | 11/1978 |
| DE | 3002161 A1 | 7/1980 |

(Continued)

OTHER PUBLICATIONS

Tindall Corporation, Tindall Better Building Through Technology Underground Products Catalog, 00-00-2000, pp. 1-21, Spartanburg, South Carolina, US.

*Primary Examiner* — Kevin Murphy
(74) *Attorney, Agent, or Firm* — Nelson Mullins Riley & Scarborough LLP

(57) ABSTRACT

A manhole for connecting fluid flow between and for providing access to an inlet pipe and an outlet pipe angularly oriented to one another in a sewage, storm water or like fluid handling system. The manhole comprises an upright housing which defines a manhole interior, the housing having first and second essentially planar upstanding outer sidewalls angularly oriented to one another at substantially the same angle as between the inlet and outlet pipes and a curved upstanding outer side wall extending between the first and second planar sidewalls. First and second openings are formed respectively through the first and second planar sidewalls into the manhole interior for receiving respective ends of the inlet and outlet pipes. A base section within the manhole interior defines a curvilinear fluid flow trough between the first and second openings for conveying fluid flow from the inlet pipe to the outlet pipe.

9 Claims, 3 Drawing Sheets

(56) References Cited

U.S. PATENT DOCUMENTS

| | | | | |
|---|---|---|---|---|
| 4,406,484 | A * | 9/1983 | Ramer | 285/148.27 |
| 4,429,907 | A | 2/1984 | Timmons | |
| 4,444,221 | A | 4/1984 | LaBenz | |
| 4,461,498 | A | 7/1984 | Kunsman | |
| 4,484,724 | A | 11/1984 | Srackangast | |
| 4,614,324 | A | 9/1986 | Yamashita et al. | |
| 4,768,813 | A | 9/1988 | Timmons | |
| 5,584,317 | A | 12/1996 | McIntosh | |
| 6,325,423 | B1 * | 12/2001 | Guggemos | 285/189 |
| 6,968,854 | B2 | 11/2005 | Mokrzycki et al. | |
| 2004/0040221 | A1 | 3/2004 | Airheart | |
| 2008/0141445 | A1 | 6/2008 | Guitoneau | |

FOREIGN PATENT DOCUMENTS

| | | | |
|---|---|---|---|
| DE | 3637412 | A1 | 5/1988 |
| EP | 0740024 | A1 | 10/1996 |
| FR | 2701500 | A1 | 8/1994 |
| GB | 2043812 | A | 10/1980 |
| JP | 408333763 | A | 12/1996 |
| JP | 10140589 | A | 5/1998 |
| WO | 9118151 | A1 | 11/1991 |

* cited by examiner

MANHOLE

CROSS-REFERENCE TO RELATED APPLICATION

The present application is entitled to the benefit of, and claims priority from, U.S. Provisional Patent Application Ser. No. 61/284,717, filed Dec. 23, 2009, and entitled "MANHOLE," the entirety of which is incorporated herein by reference.

FIELD OF THE INVENTION

The present invention relates generally to manholes of the type providing access to an underground utility system such as a storm water or sewer water handling system and, more particularly, to a manhole of an unconventional configuration that uniquely provides a more compact footprint for a given fluid handling system of a given fluid handling capacity than conventional manholes for the same fluid handling system with the same fluid handling capacity.

BACKGROUND OF THE INVENTION

Utility manholes for storm water, sewer water and like underground utility systems are situated at periodic intervals along the length of the fluid handling system, both periodically along straight lengths and at bends in the system, to provide a network of access points into the system from above ground. Such manholes are typically cast of concrete and may be fabricated on-site or, more preferably and more typically in the current state-of-the-art, precast in a factory setting and transported to an installation site.

Manholes are conventionally constructed of a round outer housing, i.e., circular in horizontal cross-section, within which a formed concrete basin defines a water flow trough, commonly referred to as an invert, between space-apart lateral openings in the housing. The incoming and outgoing openings in the manhole housing may be aligned with one another for straight-through water flow, or may be disposed at angles to one another, usually no less than ninety degrees) (90°, for a transition in flow direction. The trough connecting between the openings must have a curvature providing a smooth transition through the angular turn.

The size of manholes is an important factor in the design and construction of a utility system. The larger the manhole, the more difficult is the installation and the greater is the cost. Large manholes may not be possible to pre-fabricate off-site, requiring more expensive on-site in-situ fabrication. Conventionally, the size of a manhole is dictated as a function of the size of the pipe connecting into the incoming and outgoing sides of the manhole. The outer diameter of the manhole housing must be large enough and the wall thickness of the manhole housing must be thick enough to allow for the formation of recessed countersunk openings, each with a flat stop face, to accommodate the diameter of the incoming and outgoing pipes and thereby to facilitate secure sealed connection of the pipes to the manhole housing. Thus, smaller diameter round manholes, because of the curvature thereof, cannot accommodate incoming and outgoing large diameter pipes, even though the interior space within the manhole may be able to accommodate the necessary trough curvature.

SUMMARY OF THE INVENTION

The present invention addresses this problem by departing from the conventional wisdom of fabricating manholes in a round configuration and, instead, fabricates manholes with flat side faces at the incoming and outgoing locations of the connecting inlet and outlet pipes, the flat side faces being angularly oriented to one another by the same degree spacing as the required bend between the inlet and outlet pipes. Within the manhole, the trough is formed with an appropriate curvature to provide optimal water flow through the manhole from the inlet pipe to the outlet pipe.

In a typical embodiment, the manhole of the present invention is adapted for connecting fluid flow between and for providing access to an inlet pipe and an outlet pipe angularly oriented to one another in a sewage, storm water or like utility system. The manhole comprises an upright housing which defines a manhole interior, the housing having first and second essentially planar upstanding outer sidewalls angularly oriented to one another at substantially the same angle as between the inlet and outlet pipes and a curved upstanding outer side wall extending between the first and second planar sidewalls. First and second openings are formed respectively through the first and second planar sidewalls into the manhole interior for receiving respective ends of the inlet and outlet pipes. A base section within the manhole interior defines a curvilinear fluid flow trough between the first and second openings for conveying fluid flow from the inlet pipe to the outlet pipe.

In preferred embodiments of the present invention, the housing of the manhole has a footprint that is more compact than a cylindrical manhole accommodating the same inlet and outlet pipes with the same manhole capacity. The first and second planar outer walls have a horizontal dimension selected to be sufficient to accommodate the lateral diameter of the inlet and outlet pipes, yet The housing preferably further comprises a top section spanning between the first and second planar outer walls and the curved outer wall, the top section having an opening for providing access into the manhole interior.

The manhole further comprises a means, arrangement or device for sealing the ends of the inlet and outlet pipes respectively to the first and second planar sidewalls within the respective first and second openings thereof. For example, to facilitate sealing of the pipe ends to the planar side walls, in some embodiments of the present invention each of the first and second openings comprises an annular shoulder countersunk into the respective first and second planar outer walls for abutment with the respective ends of the inlet and outlet pipes.

In a typical embodiment, the trough has a defined radius and the curved outer wall has a curvature generally corresponding to the trough radius. Typically, the trough is upwardly open and may preferably have a compound arcuate curvature longitudinally and transversely of the trough.

BRIEF DESCRIPTION OF THE DRAWINGS

These and other features, aspects and advantages of the present invention will be described hereinafter in relation to preferred embodiments of the invention as illustrated in the accompanying drawings, wherein.

DETAILED DESCRIPTION OF THE PREFERRED EMBODIMENTS

Figure 1:
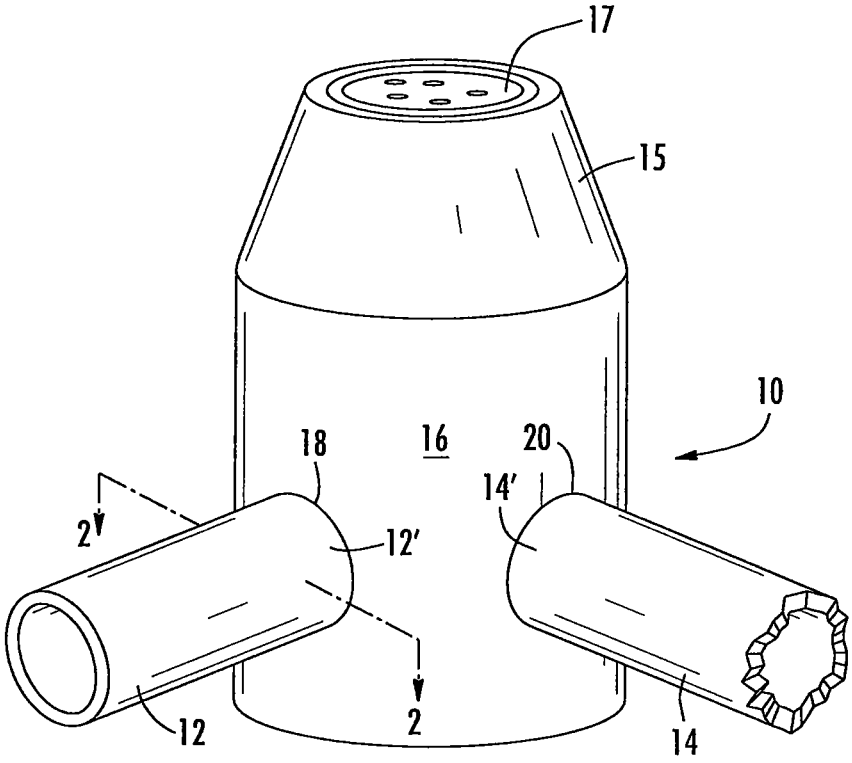
FIG. 1 PRIOR ART
FIG. 1 is a perspective view of a conventional form of manhole or the general type commonly employed for access to an underground sewer or storm water drainage flow system.
Figure 2:
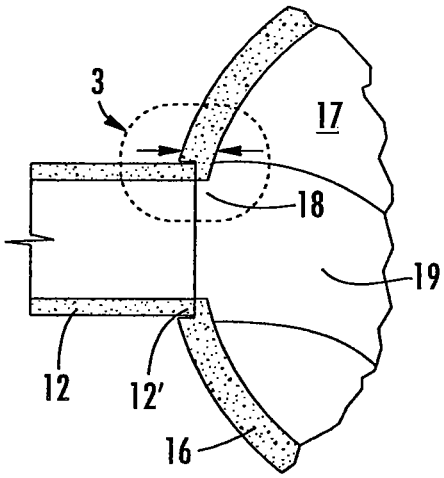
FIG. 2 PRIOR ART
FIG. 2 is a horizontal cross-sectional view of the manhole of FIG. 1, taken along line 2-2 thereof.
Figure 3:
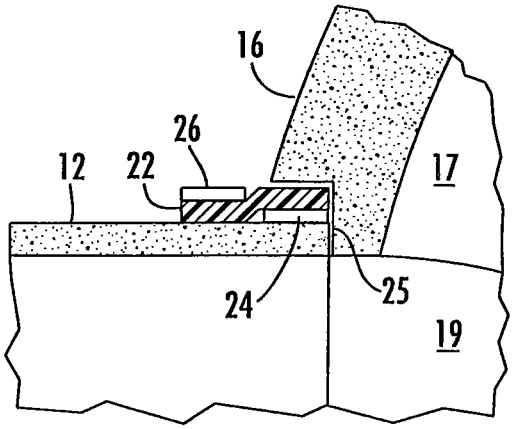
FIG. 3 PRIOR ART
FIG. 3 is an enlargement of the area 3 in the horizontal cross-section of the manhole of FIG. 2.

Referring now to the accompanying drawings and initially to FIGS. 1-3, a typical prior art manhole is indicated generally at 10 at the junction between angularly oriented inlet and outlet pipes 12,14. In the installation as illustrated, the pipes 12, 14 are oriented perpendicularly, but persons skilled in the art will recognize and understand that the pipes may be oriented in manholes of the illustrated type at varying angles, typically ranging between ninety and one hundred eighty degrees (90°-180°).

The manhole 10 is of a conventional construction situated vertically upright within the ground at the desired location, typically within an excavated area, having a circularly tubular manhole housing 16 which may be a unitary member either precast off-site of concrete or a similar hard-setting cementitious material and transported to the installation site or cast in-situ on-site using appropriate forming members. A riser section 15, typically of a tapered frusto-conical tubular configuration also cast of concrete or like material, extends upwardly from the manhole housing 16 to extend between the subterranean location of the housing 16 within the excavated area and the level of the ground surface thereabove, thereby to provide for ingress and egress into and from the interior of the manhole housing 16. A manhole cover 17 rests removably within the upper end of the riser section 15 to open and close access into the riser section 15.

The inlet and outlet pipes 12,14 typically are circular pipe of the conventional precast concrete type and the manhole housing 16 has formed therein at its lower end respective circular openings 18,20 of a slightly larger diameter than the pipe through which openings 18,20 the respective ends 12', 14' of the pipes 12,14 slightly extend horizontally to open into the interior of the manhole housing 16. As will be understood, the manhole 10 performs the dual function of connecting the flow paths of the pipes 12,14 and providing access into each pipe 12,14 for maintenance, repair or any other similar reason. To provide the desired connection of the flow paths of the pipes 12,14, a basin floor 17 (FIG. 2) is constructed of concrete or like material at the bottom of the manhole housing 16 to approximately one-half the height of the pipe ends 12',14' and a trough 19, normally referred to as an invert, is formed in the basin floor to define a fluid flow path extending between the two pipe ends 12',14', all as is conventional.

The connection between the ends 12',14' of the pipes 12,14 and the openings 18, 20 in the manhole housing 16 must be appropriately sealed around the full circumference of the pipes to prevent undesired exfiltration of storm or sewer water out of the underground fluid flow system as well as to prevent infiltration of ground water into the system. The pipe ends 12',14' may be sealed to the manhole housing 16 in differing ways. For example, in the past, it was commonplace to manually seal the pipe connection with mortar or grout. Currently, as best shown in FIG. 3, it is more typical and preferred to form the manhole openings 18, 20 of a countersunk configuration presenting a flat annular shoulder surface 25 recessed within the manhole housing 16 annularly about each opening to receive the respective pipe end with a circular band-type seal 22 surrounding the pipe end. A first expandable band clamp, only representatively indicated at 24, is typically disposed within the countersunk area inside the seal 22 to compress the seal radially outwardly into surface contact with the countersunk recess. A second compressible band clamp, only representatively indicated at 26, is the typically disposed to encircle the seal 22 outside the countersunk area to compress the seal radially inwardly against the outer exterior surface of the pipe end.

As persons skilled in the relevant art are aware and will appreciate, there are interrelated structural considerations in the fabrication of conventional circular manholes of the above-described type which effectively determine the minimum overall diametric size to which a given manhole must be constructed. Under standards promulgated by ASTM International, the diameter of sewer and storm water flow pipe must be sufficient to carry a given volume of water flowing at a given rate of speed to handle an expected maximum capacity for a given storm or sewer water drainage system. ASTM International standards further provide that the invert trough 19 within a manhole must have a minimum outside radius of curvature between the inlet and outlet pipes 12, 14 no less than 1.5 times the diameter of the pipes. In turn, the manhole housing 16 in the area surrounding the openings 18, 20 must be of a sufficient radial thickness dimension to accommodate the formation of an appropriate countersunk recess in a sufficient diameter to receive the ends of the inlet and outlet pipes 12, 14, in order to accommodate the above-described manner of sealed connection between the pipes and the manhole housing 16.

These structural requirements effectively dictate a minimum circular diameter of the manhole housing 16 for a given circular diameter of the inlet and outlet pipes 12, 14. That is, for a manhole housing of a relatively small cross-sectional diameter, the outer circumferential curvature of the housing will be too sharp to permit the formation of countersunk openings larger than a certain diameter, whereby smaller diameter manhole housings typically cannot accommodate larger diameter inlet and outlet pipes, even though the interior space within a smaller diameter manhole may be sufficient to accommodate the curvature required for the invert trough between such pipes. In effect, therefore, a circular manhole housing must often be fabricated to a larger diameter than is necessary to provide enough interior space to accommodate the required radius for the interior trough, in order to flatten the housing curvature sufficiently to allow for the formation of countersunk pipe openings.

This is a significant disadvantage of conventional circular manholes, as larger manholes require greater amounts of concrete, with attendant greater bulk and weight, and greater cost. Above a given diameter, typically 7 to 8 feet, circular manholes cannot be effectively fabricated by pre-casting off-site in a factory setting because of the highway limitations and other difficulties in transporting larger manholes to an installation site and the attendant difficulties in handling the off-loading and installation of such manholes once at the site. The alternative of fabricating manholes in situ on-site, however, adds further expense, particularly labor expense.

The manhole of the present invention addresses and overcomes these problems in the prior art by departing from the conventional wisdom that manholes should be of a circular cross-sectional shape and, instead, contemplates the unique fabrication of manhole housings with flat planar vertical sidewalls whereat the inlet and outlet pipes connect into the manhole housing, with the sidewalls angularly oriented to one another at the same angle as between the pipes so as to receive the pipes perpendicularly to their respective axes.

Figure 4:
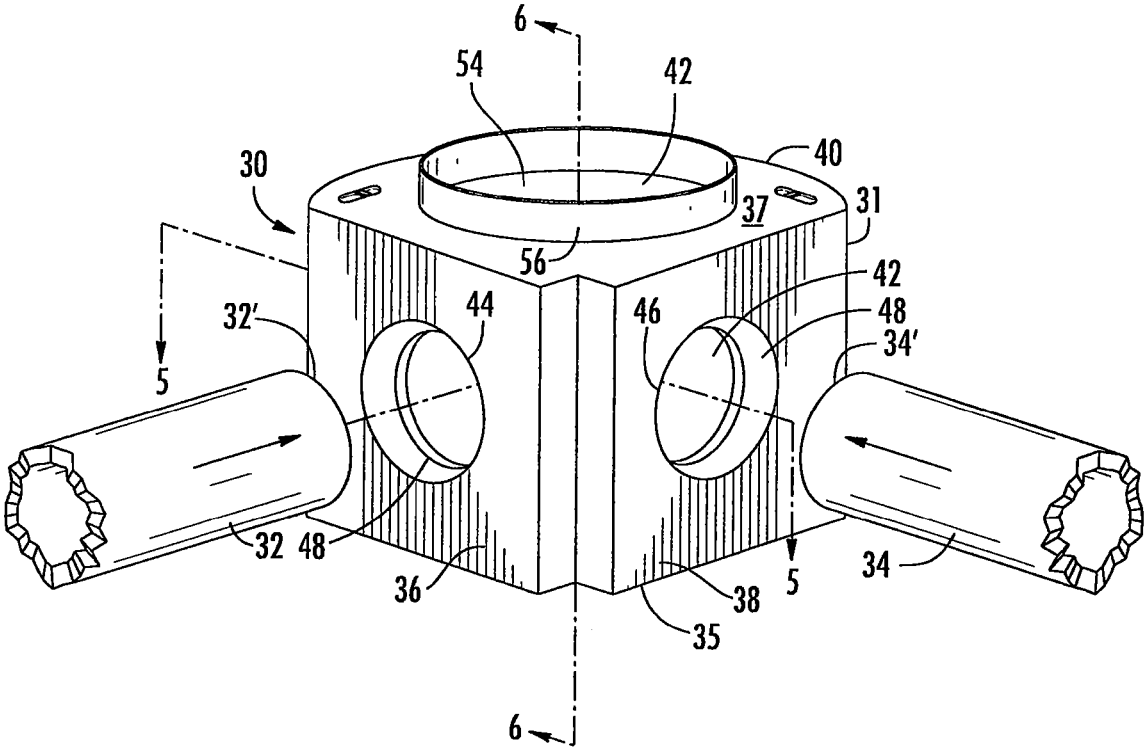
FIG. 4 is a perspective view of a manhole adapted in accordance with a preferred embodiment of the present invention for use in a sewer or storm water drainage flow system instead of manholes of the type of FIGS. 1-3.
Figure 5:
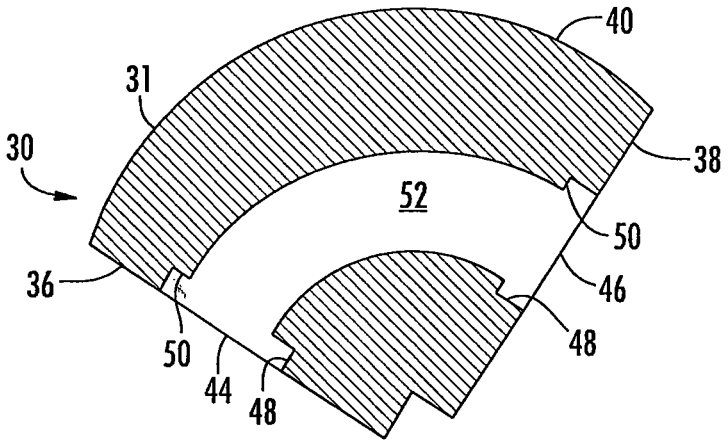
FIG. 5 is a horizontal cross-sectional view of the manhole of FIG. 4, taken along line 5-5 thereof.
Figure 6:
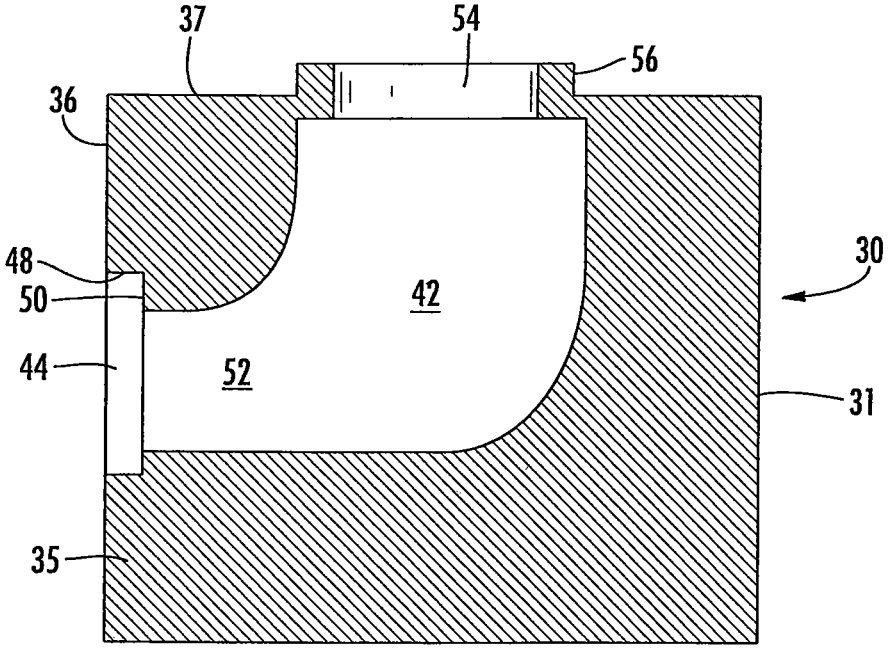
FIG. 6 is a vertical cross-sectional view of the manhole of FIG. 4, taken along line 6-6 thereof.

With reference to FIGS. 4-6, a manhole in accordance with the present invention is indicated generally at 30. The manhole 30 basically comprises a housing 31 of a configuration suitable for joining and inlet pipe 32 and outlet pipe 34 oriented at a ninety degree)(90° angle to one another, but it is contemplated and it is to be understood that manhole housings may be constructed in accordance with the present invention in any of a variety of other configurations for connecting between inlet and outlet pipes oriented at other relative angles, whether less than or greater than 90°. The manhole housing 31 is preferably fabricated of concrete, but the present invention is not to so limited and it is contemplated that the manhole housing 31 may be formed of any other cementitious material or another suitable casting material providing appropriate strength, rigidity and corrosion resistance properties.

The manhole housing 31 basically comprises first and second essentially planar upstanding outer sidewalls 36, 38 of a square or rectangular outer perimetric shape with lateral side edges disposed adjacent one another and with the main surfaces of the sidewalls 36, 38 extending angularly with respect to one another away from their adjacent side edges at a horizontal angle corresponding to the horizontal angle between the respective axes of the inlet and outlet pipes 32, 34. A third upstanding outer sidewall 40 extends in a horizontal arcuate curvature between the respective laterally outermost side edges of the sidewalls 36, 38. The manhole housing 31 further includes a solid base 35 spanning horizontally between the lowermost ends of the sidewalls 36, 38, 40, and a top wall 37 at a vertical spacing from the base 35 spanning horizontally between the uppermost ends of the sidewalls 36, 38, 40.

The manhole housing 31 defines an open interior area 42 between the respective sidewalls 36, 38, 40, base 35 and top wall 37 to provide for fluid flow (storm water, sewage, or other transported fluid) therethrough, with a circular opening 44, 46, respectively, being formed through each flat sidewall 36, 38 to open into the interior area 42. Each sidewall opening 44, 46 is of an interior diameter essentially corresponding to the interior diameter of the pipes 32, 34, with each sidewall opening 44, 46 being outwardly bordered by a countersunk recess 48 forming a perimeter shoulder 50 (FIGS. 5 and 6) of an enlarged diameter sufficiently greater than the outer diameter of the pipes 32, 34 to receive an end 32', 34' of each pipe together with a seal and clamp arrangement of the type previously described and depicted in FIG. 2.

A fluid flow trough 52 is formed as an upwardly open recessed depression in the base 35 in a vertical cross-sectional shape conforming to and merging with the lower half of each sidewall opening 44, 46 to direct fluid flow through the manhole interior 42 between the openings 44, 46. In conformity to ASTM standards, the trough 52 is of a curvature whose outermost radius is at least 1.5 times the interior diameter of the pipes 32, 34 and whose innermost radius is less than the outermost radius by the pipe diameter. Preferably, to promote smooth fluid flow with minimal turbulence, the trough 52 has a compound arcuate curvature in both longitudinal and transverse extents of the trough 52, i.e., the trough is curved substantially semi-circularly across its transverse extent normal to the longitudinal extent of the trough for the entirety of its longitudinal extent and the trough is also substantially arcuately curved in its longitudinal extent concentrically at each transverse side thereof for the entirety of its transverse extent, such as may be advantageously produced using forming elements of the type disclosed in U.S. Pat. No. 4,484,724. The outer curvature of the wall 40 may preferably correspond to the arcuate longitudinal curvature of the trough 52.

The top wall 37 of the manhole housing 31 is formed centrally with a vertical opening 54 providing access downwardly through the wall 37 into the manhole interior 42. The vertical opening 54 is surrounded by an upstanding perimeter collar 56 to receive a riser section (not shown) to extend vertically between the manhole housing 30, when installed below ground, and the ground surface thereabove.

The manhole 30, by virtue of its unique configuration owing to the flat sidewalls 36, 38, provides a substantially smaller footprint in horizontal cross-section than a conventional circular manhole constructed to accommodate the same fluid flow capacity between the same inlet and outlet pipes 32, 34 at the same angular orientation. The flat sidewalls 36, 38 need only have a sufficient width and height across their respective rectangular or square surface as necessary to accommodate the required diameter of the openings 44, 46 together with the countersunk recesses 48 surrounding the openings 44, 46. In turn, the curved wall 40 can follow the curvature of the invert trough 52, whereby the walls 36, 38, 40 defined therewithin a sufficient footprint for a volume of concrete for the base section 35 and the trough 52. The overall resulting footprint of the manhole 30 therefore occupies substantially less horizontal surface area than would be required for a circular manhole of the same capacity, thereby saving material costs without compromising performance. The manhole 30 is also of a significantly lesser weight than a comparable circular manhole, enabling the factory precasting of manholes having a wider range of flow capacities than is currently possible in precasting circular manholes. The lesser weight of the manhole 30 additionally offers savings in transportation costs from the precast factory to installation sites.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A manhole for connecting fluid flow between and for providing access to an inlet pipe and an outlet pipe angularly oriented to one another in a utility system, including a sewage or storm water utility system, the manhole comprising an upright housing defining a manhole interior, the housing being generally in the form of a circular sector defined by adjacent first and second essentially planar upstanding outer sidewalls extending generally as respective radii of the circular sector from adjacent a common center to respective outer distal wall ends, the sidewalls being angularly oriented to one another at substantially the same angle as between the inlet and outlet pipes, and a curved upstanding outer side wall extending arcuately between the outer distal wall ends of the first and second planar sidewalls, first and second openings formed respectively through the first and second planar sidewalls into the manhole interior for receiving respective ends of the inlet and outlet pipes, and a sector-shaped base section within the manhole interior defining a curvilinear fluid flow trough between the first and second openings for conveying fluid flow from the inlet pipe to the outlet pipe.

2. A manhole according to claim 1, wherein each of the first and second openings comprises an annular shoulder countersunk into the respective first and second planar outer walls for abutment with the respective ends of the inlet and outlet pipes.

3. A manhole according to claim 1, wherein the trough has a compound arcuate curvature longitudinally and transversely of the trough.

4. A manhole according to claim 1, wherein the trough is upwardly open.

5. A manhole according to claim 1, further comprising means for sealing the ends of the inlet and outlet pipes respectively to the first and second planar sidewalls within the respective first and second openings thereof.

6. A manhole according to claim 1, wherein the housing further comprises a top section spanning between the first and second planar outer walls and the curved outer wall, the top section having an opening for providing access into the manhole interior.

7. A manhole according to claim 1, wherein the trough has a curvature generally corresponding to the curved outer wall.

8. A manhole according to claim 7, wherein the first and second planar outer walls have a horizontal dimension selected to accommodate the lateral diameter of the inlet and outlet pipes.

9. A manhole according to claim 1, wherein the first and second planar outer walls have a horizontal dimension selected to accommodate the lateral diameter of the inlet and outlet pipes.

* * * * *